United States Patent [19]

Mori et al.

[11] Patent Number: 4,640,761

[45] Date of Patent: Feb. 3, 1987

[54] PROCESS FOR PREPARING PITCH

[75] Inventors: Makihiko Mori, Nara; Satoshi Kibe, Kashihara; Toyohiro Maeda, Tenri, all of Japan

[73] Assignee: Osaka Gas Company Limited Osaka Japan

[21] Appl. No.: 606,778

[22] PCT Filed: Aug. 27, 1983

[86] PCT No.: PCT/JP83/00279

§ 371 Date: Apr. 17, 1984

§ 102(e) Date: Apr. 17, 1984

[87] PCT Pub. No.: WO84/00975

PCT Pub. Date: Mar. 15, 1984

[30] Foreign Application Priority Data

Aug. 30, 1982 [JP] Japan ..... 57-151621

[51] Int. Cl.[4] ..... C10C 1/20; C10C 3/02

[52] U.S. Cl. ..... 208/44; 208/42; 208/45; 208/309; 208/39

[58] Field of Search ..... 208/42, 44, 45, 309

[56] References Cited

U.S. PATENT DOCUMENTS

| | | | |
|---|---|---|---|
| 659,076 | 10/1900 | Lennard | 208/42 |
| 1,844,896 | 2/1932 | Miller | 208/42 |
| 2,449,404 | 9/1948 | Miller | 208/45 |
| 2,631,982 | 3/1953 | Donegan | 208/39 |
| 3,010,893 | 11/1961 | Kulik | 208/42 |
| 3,970,524 | 7/1976 | Borgertman | 208/44 |
| 3,992,281 | 11/1976 | Benade | 208/45 |
| 4,259,171 | 3/1981 | Stadelhofer et al. | 208/309 |
| 4,264,453 | 4/1981 | Mravick | 208/45 |
| 4,402,824 | 9/1983 | Sunami et al. | 208/45 |
| 4,405,439 | 9/1983 | Simone | 208/45 |
| 4,436,615 | 3/1984 | Boodman et al. | 208/39 |
| 4,482,452 | 11/1984 | Shigeta et al. | 208/39 |

FOREIGN PATENT DOCUMENTS

| | | | |
|---|---|---|---|
| 1116792 | 9/1980 | Japan | 208/45 |
| 181612 | 5/1965 | U.S.S.R. | 208/42 |
| 342886 | 9/1972 | U.S.S.R. | 208/45 |
| 595358 | 3/1978 | U.S.S.R. | 208/42 |

*Primary Examiner*—Andrew H. Metz
*Assistant Examiner*—Helane Myers
*Attorney, Agent, or Firm*—Larson and Taylor

[57] ABSTRACT

Pitch free from quinoline insoluble components is prepared by heat-treating coal tar or coal tar pitch in the absence or in the presence of carbonaceous particles and centrifuging at a high temperature the reaction product resulting from the heat treatment or a mixture of the reaction product from the heat treatment and coal tar-type light or middle oil.

30 Claims, No Drawings

PROCESS FOR PREPARING PITCH

TECHNICAL FIELD

This invention relates to a process for preparing pitch and more particularly to a process for preparing pitch containing little or substantially no quinoline insoluble components (hereinafter referred to as "QI components").

BACKGROUND ART

In producing high-quality carbon materials such as needle coke, carbon fiber or the like from coal tar, QI components contained as impurities in the coal tar must be removed to utmost extent. The QI components in coal tar are carbonaceous materials in the form of fine particle 0.3 μm or less in particle size (such QI components are generally called "primary QI components"). When coal tar contains a large amount of primary QI components, the primary QI components tend to adhere to the surface of mesophase bodies (spherulites generally called "secondary QI components") during the heat treatment of the coal tar. The adhesion of primary QI components is presumed to inhibit the aggregation of the spherulites and to hinder their normal growth.

For this reason, the removal of primary QI components from coal tar has been recognized as important. For example, a method has been practiced in which oil of such property that the oil and coal tar are hardly miscible each other, e.g. petroleum-type light oil, is added to coal tar to aggregate the primary QI components of the coal tar into particles of increased particle size and the mixture is left to stand to separate the enlarged solids by sedimentation (Japanese Unexamined Patent Publication No. 28501/1977). This method requires the distillation of the supernatant liquid after removing the primary QI components in order to get tar and/or pitch as useful component and must recover the oil initially added by distillation. The distillation of the liquid requires a great amount of thermal energy and also results in low yields of the useful component. Further, the oil recovered by the distillation is a mixture of the petroleum-type oil added and coal-type oil derived from coal tar and thus has a limited value in use unless further treated. Since the precipitate phase separated by standing contains a large amount of petroleum-type oil, the oil as added would be recovered at a low ratio if the precipitate is not subjected to a treatment for the recovery of oil. And the recovery treatment requires equipments such as a distillation column, tanks, etc. Moreover, this method involves the use of a large-size tank for storing petroleum-type light or middle oil to be used and related installations, consequently demanding a wide space for arrangement of the equipments.

DISCLOSURE OF INVENTION

We have conducted extensive research to solve or moderate the foregoing problems encountered in carrying out the conventional methods and found the following.

(i) When coal tar or coal tar pitch is heat-treated before centrifugation at high temperatures, the primary QI components are aggregated into solids of increased apparent particle size so that a remarkable centrifugal efficiency is achieved and the primary QI components are efficiently separated with extreme ease.

(ii) When carbonaceous particles are added to coal tar or coal tar pitch before the heat treatment in the procedure as described above in (i), the secondary QI components produced by the heat treatment act as a kind of binder to stick the primary QI components to the surfaces of carbonaceous particles. As a result, the primary QI components which have swollen the carbonaceous particles are easily and efficiently separated together with the carbonaceous particles by centrifuging at a high temperature the reaction product from the heat treatment.

(iii) When coal tar-type light or middle oil is added to the reaction product resulting from the heat treatment of coal tar or coal tar pitch in the procedure stated above in (i) or (ii) before high-temperature centrifugation, the reaction product is rendered less viscous and the high-temperature centrifugal efficiency is further improved.

The present invention has been accomplished based on these novel findings.

In the process of the present invention, coal tar or coal tar pitch is subjected first to heat treatment. The heat treatment is conducted usually at a temperature of about 300° to about 500° C. and a pressure in the range of around ambient pressure to about 20 kg/cm$^2$·G for about 0.5 to about 50 hours. Preferably it is carried out at a temperature of about 350° to about 450° C. under the same pressure and time conditions as above. Particulate secondary QI components are formed in the reaction system during the heat treatment and the apparent particle size of the particulate secondary QI components is increased by the adhesion of primary QI components to the surface of the secondary QI components, thereby enabling the subsequent high-temperature centrifugation to easily separate and remove the primary QI components.

The heat treatment of coal tar or coal tar pitch in the present invention can be carried out in the presence of carbonaceous particles. In this case, the secondary QI components produced by the heat treatment of coal tar or coal tar pitch act as a binder to stick the primary QI components to the surface of the carbonaceous particles. Consequently, the high-temperature centrifugation can easily remove the swollen carbonaceous particles together with the primary and secondary QI components, achieving the separation of primary QI components with higher efficiency. Useful carbonaceous, particles include a wide variety of those containing carbonaceous materials as a main component, such as coal powder, coke powder, etc. The carbonaceous particles to be used range in particle size from usually about 10 to about 500 μm, preferably about 50 to about 150 μm. The carbonaceous particles less than 10 μm in particle size have a small adsorption area and are difficult to produce, while those over 500 μm in particle size sediment on addition of the particles to starting coal tar. The amount of the carbonaceous particles to be used is usually about 1 to about 50 parts by weight, preferably about 3 to about 10 parts by weight, per 100 parts by weight of coal tar. The heat treatment of coal tar or coal tar pitch in the case of addition of carbonaceous particles is conducted under the same conditions as the foregoing treatment without addition thereof.

The coal tar or coal tar pitch heat-treated in the presence or in the absence of carbonaceous particles is centrifuged at 100° to 450° C. The centrifugation at less than 100° C. entails difficulty in removing a sufficient amount of QI components and that at temperatures over 450° C. involves an increased tendency to generate gas due to the thermal decomposition of tar or pitch or to change the physical and/or chemical properties of tar or pitch. More preferable centifugal temperature is form 200° to 400° C. Various types of centrifugal separators can be used which are operable at the temperature in the above range. The centrifugal force to be applied is usually about 500 to about 3500 G, preferably about 2000 to about 3500 G. The percent removal of QI components is suitably determined according to the properties of starting coal tar, kind of the desired end product, etc. For example, when producing materials for needle coke from coal tar containing 3.5% of QI components, the preferred percentage of the removed QI components is over 90%, but the preferred percentage is over 95% when producing materials for carbon fibers from the same kind of coal tar. When required, the supernatant liquid obtained by the centrifugation is distilled by the usual method and further treated to prepare specific end products.

In the present invention, coal tar-type light or middle oil can be added, before high-temperature centrifugation, to the reaction product resulting from the heat treatment. The addition of such oil renders the reaction product from the heat treatment less viscous, thereby enabling the centrifuge to operate at a reduced temperature in the range of 80° to 300° C. and to remove the QI components with higher efficiency. Examples of useful coal tar-type light or middle oils are those having a boiling range of about 80° to about 350° C., such as creosote oil, naphthalene oil anthracene oil, etc. The coal tar-type light or middle oil is added in an amount of preferably about 20 to about 200 parts by weight, more preferably about 50 to about 150 parts by weight, per 100 parts by weight of the reaction product from the heat treatment. The distillation of the supernatant liquid obtained by removing a predetermined amount of QI components with a centrifuge gives the desired material for use in manufacture of carbon materials in high yields and recovers coal tar-type oil. The recovered oil can be reused as oil to be added to the reaction product from the heat treatment. When coal tar-type light or middle oil is added to the reaction product from the heat treatment, it is preferred to operate the centrifuge at a temperature of 100° to 250° C.

The process of the present invention can achieve the following results.

(a) The QI components can be easily and efficiently removed from coal tar and the useful component (heat-treated tar or pitch) having a low content of QI components can be obtained in high yields.

(b) A solvent need not invariably be used.

(c) Even when a solvent is used, the oil recovered by distillation after centrifugation consists of coal tar-type oil alone since coal tar-type light or middle oil is employed. Thus the recovered oil can be effectively used.

(d) The amount of thermal energy consumed is reduced.

(e) The process of the present invention requires no equipment for distilling the precipitate phase nor a large-size tank for containing the oil obtained by the distillation of the precipitate phase.

The following Examples are given to clarify the present invention.

EXAMPLE 1

Coal tar containing 3.7% by weight of primary QI components was heat-treated at a temperature of 410° C. and a pressure of 10 kg/cm$^2$·G for 4 hours to give heat-treated tar in a yield of 95% by weight.

The tar thus heat-treated was centrifuged at the temperatures as shown in Table 1 below, removing the QI components with the result as indicated in Table 1 below.

The centrifuge used was of the multi-container type equipped with 4 containers each 500 ml in volume and operated at the revolutions of 2500 rpm and a centrifugal force of 900 G. The centrifugation was completed in 10 minutes.

EXAMPLE 2

A 60 part-by-weight portion of creosote oil having a boiling range of 170° to 350° C. was added to 100 parts by weight of the tar heat-treated in the same manner as Example 1. The mixture was centrifuged at the temperatures as shown in Table 1 below and under the same conditions as Example 1, removing the QI components with the result as listed in Table 1 below.

TABLE 1

| Temperature (°C.) | Percentage of removed QI components (%) | |
|---|---|---|
| | Example 1 | Example 2 |
| 80 | 35 | 65 |
| 100 | 81 | 92 |
| 150 | 89 | 98 |
| 220 | 97 | — |

The percentages of the removed QI components in Table 1 and other tables appearing hereinafter are given by the following equation.

Percentage of removed *QI* components =

$$\left\{ 1 - \frac{(\text{wt. \% } QI \text{ in supernatant liq.}) \times \dfrac{(\text{Amount of heat-treated tar } (l)) + (\text{Amount of creosote oil } (l))}{\text{Amount of heat-treated tar } (l)}}{\dfrac{(\text{wt. \% } QI \text{ in starting tar})}{(\text{wt. \% yield of heat-treated tar})} \times 100} \right\} \times 100$$

EXAMPLE 3

Coal tar containing 3.1% by weight of primary QI components was heat-treated at a temperature of 400° C. and a pressure of 3 kg/cm$^2$·G for 6 hours to give heat-treated tar in a yield of 76% by weight.

The heat-treated tar was centrifuged at the temperatures as shown in Table 2 below, removing the QI components with the efficiency as indicated in Table 2 below.

The centrifuge used was of the transverse- and continuous-type having a holding volume of 40 l and was operated at the revolutions of 3000 rpm, a centrifugal force of 2280 G and a treating amount of 1 ton per hour.

EXAMPLE 4

A 50 part-by-weight portion of creosote oil having a boiling range of 170° to 350° C. was added to 100 parts by weight of the tar heat-treated in the same manner as Example 3. The mixture was centrifuged at the temperature as shown in Table 2 below and under the same conditions as Example 3, removing the QI components with the result as indicated in Table 2 below.

TABLE 2

| Example | Temp. (°C.) | QI in supernatant liq. (wt. %) | Percentage of removed QI components (%) |
|---|---|---|---|
| 3 | 270 | 0.24 | 94 |
| 4 | 150 | 0.14 | 95 |

EXAMPLE 5

A mixture of 100 parts by weight of coal tar of the same type as used in Example 3 and 3.5 parts by weight of coal powder 60 to 100 μm in particle size was heat-treated at a temperature of 390° C. and a pressure of 3 kg/cm$^2$·G for 6 hours to give heat-treated tar in a yield of 80% by weight.

The tar thus heat-treated was centrifuged at the temperature as shown in Table 3 below, removing the QI components with the efficiency as indicated in Table 3 below.

The centrifuge used was of the same type as employed in Example 3 and the centrifugation was conducted under the same conditions as Example 3 with the exception of the temperature.

EXAMPLE 6

A 50 part-by-weight portion of creosote oil having a boiling range of 170° to 350° C. was added to 100 parts by weight of the tar heat-treated in the same manner as Example 5. The mixture was centrifuged under the same conditions as Example 5 with the exception of employing the temperature as indicated in Table 3 below, removing the QI components with the result as indicated in Table 3 below.

TABLE 3

| Example | Temp. (°C.) | QI in supernatant liq. (wt. %) | Percentage of removed QI components (%) |
|---|---|---|---|
| 5 | 230 | 0.07 | 98 |
| 6 | 140 | 0.08 | 97 |

We claim:

1. A process for preparing pitch comprising the steps of heat-treating coal tar or coal tar pitch at a temperature of 300° to 500° C. and a pressure ranging from ambient pressure to 20 kg/cm$^2$·G for 0.5 to 50 hours to cause the aggregation of quinoline insoluble components 0.3 μm or less in particle size into solids of increased apparent particle size and centrifuging the heat-treated material at a temperature of 100° to 450° C. and at a centrifugal force of 500 to 3,500 G to remove the aggreated solids of quinoline insoluble component and recovering said pitch.

2. A process as defined in claim 1 in which the heat treatment is conducted at a temperature of 350° to 450° C. and a pressure in the range of ambient pressure to 20 kg/cm$^2$·G for 0.5 to 50 hours.

3. A process as defined in claim 1 in which the centrifugation is carried out at a temperature of 200° to 400° C.

4. A process as defined in claim 1 in which the centrifugation is effected at a centrifugal force of 2000 to 3500 G.

5. A process for preparing pitch comprising the steps of heat-treating coal tar or coal tar pitch at a temperature of 300° to 500° C. and a pressure in the range of ambient pressure to 20 kg/cm$^2$·G for 0.5 to 50 hours to cause the aggregation of quinoline insoluble components 0.3 μm or less in particle size into solids of increased apparent particle size, adding coal tar-type light or middle oil to the reaction product resulting from the heat treatment and centrifuging the mixture at a temperature of 80° to 300° C. and at a centrifugal force of 500 to 3,500 G to remove the aggregated solids of quinoline insoluble components and recovering said pitch.

6. A process as defined in claim 5 in which the heat treatment is conducted at a temperature of 350° to 450° C. and a pressure in the range of ambient pressure to 20 kg/cm$^2$·G for 0.5 to 50 hours.

7. A process as defined in claim 5 in which the centrifugation is carried out at a temperature of 100° to 250° C.

8. A process as defined in claim 5 in which the coal tar-type light or middle oil has a boiling range of 80° to 350° C.

9. A process as defined in claim 5 in which the coal tar-type light or middle oil is added in an amount of 20 to 200 parts by weight per 100 parts by weight of the reaction product resulting from the heat treatment.

10. A process as defined in claim 9 in which the coal tar-type light or middle oil is added in an amount of 50 to 150 parts by weight per 100 parts by weight of the reaction product resulting from the heat treatment.

11. A process as defined in claim 5 in which the centrifugation is effected at a centrifugal force of 2000 to 3500 G.

12. A process for preparing pitch comprising the steps of heat-treating coal tar or coal tar pitch in the pressure of carbonaceous particles at a temperature of 300° to 500° C. and a pressure in the range of ambient pressure to 20 kg/cm$^{23}$·G for 0.5 to 50 hours to stick quinoline insoluble components 0.3 μm or less in particle size to carbonaceous particles and centrifuging the reaction product at a temperature of 100° to 450° C. and at a centrifugal force of 500 to 3,500 G to remove the carbonaceous particles together with the quinoline insoluble compnents and recovering said pitch.

13. A process as defined in claim 12 in which the carbonaceous particles have a particle size of 10 to 500 μm.

14. A process as defined in claim 13 in which the carbonaceous particles have a particle size of 50 to 150 μm.

15. A process as defined in claim 12 in which a mixture of 100 parts by weight of coal tar and 1 to 50 parts by weight of carbonaceous particles, or coal tar pitch produced from the mixture is subjected to the heat treatment.

16. A process as defined in claim 15 in which a mixture of 100 parts by weight of coal tar and 3 to 10 parts by weight of carbonaceous particles, or coal tar pitch produced from the mixture is subjected to the heat treatment.

17. A process as defined in claim 12 in which the heat treatment is conducted at a temperature of 350° to 450° C. and a pressure in the range of ambient pressure to 20 kg/cm$^2$·G for 0.5 to 50 hours.

18. A process as defined in any one of claims 12 to 18 in which the centrifugation is carried out at a temperature of 200° to 400° C.

19. A process as defined in claim 12 in which the centrifugation is effected at a centrifugal force of 2000 to 3500 G.

20. A process for preparing pitch comprising the steps of heat-treating coal tar or coal tar pitch in the presence of carbonaceous particles at a temperature of 300° to 500° C. and a pressure in the range of ambient pressure to 20 kg/cm$^2$·G for 0.5 to 50 hours to stick quinoline insoluble components 0.3 μm or less in particle size to carbonaceous particles, adding coal tar-type light or middle oil to the reaction product resulting from the heat-treatment and centrifuging the mixture at a temperature of 80° to 300° C. and at a centrifugal force of 500 to 3,500 G to remove the carbonaceous particles together with the quinoline insoluble components and recovering said pitch.

21. A process as defined in claim 20 in which the carbonaceous particles have a particle size of 10 to 500 μm.

22. A process as defined in claim 21 in which the carbonaceous particles have a particle size of 50 to 150 μm.

23. A process as defined in claim 20 in which a mixture of 100 parts by weight of coal tar and 1 to 50 parts by weight of carbonaceous particles, or coal tar pitch produced from the mixture is subjected to the heat treatment.

24. A process as defined in claim 23 in which a mixture of 100 parts by weight of coal tar and 3 to 10 parts by weight of carbonaceous particles, or coal tar pitch produced from the mixture is subjected to heat treatment.

25. A process as defined in claim 20 in which the heat treatment is conducted at a temperature of 350° to 450° C. and a pressure in the range of ambient pressure to 20 $kg/cm^2 \cdot G$ for 0.5 to 50 hours.

26. A process as defined in claim 20 in which the centrifugation is performed at a temperature of 100° to 250° C.

27. A process as defined in claim 20 in which the coal tar-type light or middle oil has a boiling range of 80° to 350° C.

28. A process as defined in claim 20 in which the coal tar-type light or middle oil is added in amount of 20 to 200 parts by weight per 100 parts by weight of the reaction product resulting from the heat treatment.

29. A process as defined in claim 28 in which the coal tar-type light or middle oil is added in an amount of 50 to 150 parts by weight per 100 parts by weight of the reaction product resulting from the heat treatment.

30. A process as defined in claim 20 in which the centrifugation is conducted at a centrifugal force of 2000 to 3500 G.

* * * * *